United States Patent [19]

Baker et al.

[11] 4,098,692

[45] Jul. 4, 1978

[54] DEMULSIFICATION

[75] Inventors: Alan Stuart Baker, Slough; Roger Ian Hancock, Middlesbrough, both of England

[73] Assignee: Imperial Chemical Industries Limited, London, England

[21] Appl. No.: 752,792

[22] Filed: Dec. 20, 1976

[30] Foreign Application Priority Data

Dec. 29, 1975 [GB] United Kingdom ..... 52997/75

[51] Int. Cl.[2] ..... B01D 17/04; C02B 1/18

[52] U.S. Cl. ..... 210/43; 210/59; 252/340; 252/342

[58] Field of Search ..... 210/59, 43, 54; 260/29.2 E; 252/8.55 D, 328, 329, 331, 340, 342, 343

[56] References Cited

U.S. PATENT DOCUMENTS

| | | | |
|---|---|---|---|
| 2,562,878 | 8/1951 | Blair | 260/29.2 E |
| 3,996,134 | 12/1976 | Osborn et al. | 210/59 |

*Primary Examiner*—Thomas G. Wyse

*Attorney, Agent, or Firm*—Cushman, Darby & Cushman

[57] ABSTRACT

A method of demulsifying a water in oil emulsion by contacting the emulsion with an alkyd resin in which one component of the resin is the residue of a polyalkylene glycol.

4 Claims, No Drawings

DEMULSIFICATION

The present invention relates to a method of demulsification and to compositions which are suitable for use in the method.

In U.S. Pat. No. 3,996,134 we have described and claimed a method of dispersing oil in water and compositions suitable for use in the method. The method involves contacting the oil and water with an alkyd resin in which one component of the resin comprises the residue of a polyalkylene glycol, said polyalkylene glycol being soluble in water.

We have now found that by suitable choice of alkyd preferably from amongst those disclosed in the above application and by suitable choice of concentration level in use the method and compositions may also be used to demulsify water-in-oil emulsions.

According to the present invention therefore a method of demulsifying a water-in-oil emulsion comprises contacting the water in oil emulsion with an alkyd resin in which one component of said resin comprises the residue of a polyalkylene glycol.

The polyalkylene glycol component of the alkyd resin is preferably soluble in water, and by "soluble in water" we mean that at the temperature at which the alkyd is used to demulsify the water-in-oil emulsion the polyalkylene glycol would be below its cloud point.

Alkyd resins generally are the condensation products of a polybasic acid, a polyhydric alcohol and, usually a monobasic acid. The alkyd resins useful in the present invention preferably comprise the polyalkylene glycol as at least a part of the polyhydric alcohol component. Additional polyhydric alcohols which may be used include diols suitably containing up to 20 carbon atoms, such as mono, di- and tri-ethylene glycol, mono-, di- and tri-propylene glycol, mono- di- and tri-butylene glycol, and neopentyl glycol; water-insoluble polyglycols such as poly-propylene glycol and polybutylene glycol; triols suitably containing up to 20 carbon atoms such as glycerol, trimethylol propane and trimethylol ethane; polyols also suitably containing up to 20 carbon atoms such as pentaerythritol, dipentaerythritol and sorbitol; and ethoxylated amines also suitably containing up to 20 carbon atoms such as di- and tri-ethanolamine.

The polybasic acid component of the alkyd resin may be saturated, or unsaturated either by olefinic or aromatic unsaturation. Commonly used acids are aliphatic or aromatic dibasic acids containing up to 20 carbon atoms, preferably up to 10 carbon atoms such as ortho-, iso or terephthalic acid, maleic acid, fumaric acid, itaconic acid, mesaconic acid, citraconic acid, azelaic acid, succinic acid, adipic acid, glutaric acid or suberic acid. The polybasic acid may also be tri- or tetra- basic, suitably an aromatic acid containing up to 20, preferably up to 10 carbon atoms, e.g. trimellitic acid or pyromellitic acid. "Dimer" acids, i.e. mixed dibasic and tribasic carboxylic acids obtained by the polymerisation of unsaturated monobasic acids may also be used.

The optional monobasic acid component of the alkyd resin, which functions as a monofunctional chain terminator, may be derived from a free acid or from an ester of the acid, particularly a glyceride. The acid may be an aromatic acid, particularly an alkyl substituted benzoic acid but is suitably an aliphatic saturated or ethylenically unsaturated acid containing up to 30 carbon atoms, preferably 6 to 22 carbon atoms. Mixtures of acids or their esters may also be used to derive the monobasic acid component, particularly naturally occurring mixtures such as tall oil acids, or acids derived from linseed oil, soyabean oil, whale oil, dehydrated castor oil, tung oil, fish oil, safflower oil, oiticica oil, cottonseed oil or coconut oil. Individualy acids which are acceptable include iso-octanoic acid, 2-ethylhexanoic acid, isodecanoic acid, lauric acid and pelargonic acid. Other mono-basic acid chain terminators known to those expert in the field may also be used as may monohydric alcohol chain terminators which are also known for this purpose, e.g. $C_1$ to $C_{20}$ alkanols.

"Polyalkylene glycol" is the general name for polymers of an alkylene glycol which have the general formula

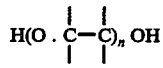

where the structure

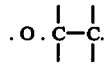

is derived from an olefine oxide and forms a polyoxyalkylene chain. For example polyethylene glycol $H(OCH_2CH_2)_n OH$ is derived from ethylene oxide

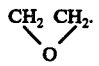

When water-soluble the polyalkylene glycol is preferably polyethylene glycol while low molecular weight polypropylene glycol or polyalkylene glycols containing a major proportion of ethylenoxy groups together with minor proportions of randomly or block distributed propylenoxy and/or butylenoxy groups may also be used. In addition to a water-soluble polyalkylene glycol residue the alkyd resin may contain residues of one or more water-insoluble polyalkylene glycols such as those of higher molecular weight polypropylene or polybutylene glycols. Furthermore the alkyd resin may contain residues of one or more polyalkylene glycols containing water-soluble polyalkylenoxy blocks together with water insoluble polyalkylenoxy blocks, for example polyethylenoxy/ polypropylenoxy block copolymers (poly(ethylene/ propylene)glycol). Alternatively, the blocks of propylene oxide and ethylene oxide units may be present in an alkoxylated amine e.g. a $C_1$ to $C_{20}$ diamine such as ethylene diamine.

The alkyd resin contains at least 5% by weight of the resin polyalkylene glycol and, more suitably, at least 10%. For preference the alkyd resin contains 40 to 90% more preferably 50 to 80% by weight of the polyalkylene glycol. It is desirable that the alkyd resin be such that it has a viscosity of at least one poise as a 95% solid solution in xylene.

The polyalkylene glycol which forms a part of the alkyd resin suitably has a molecular weight in the range 100 to 10,000 preferably 400 to 10,000 more preferably 600 to 5,000. One of the terminal hydroxyl groups of the polyalkylene glycol incorporated in the resin may, if desired, be etherified, e.g. with a lower ($C_1$ to $C_6$) alcohol such as methanol or ethanol or esterified e.g. with a lower ($C_1$ to $C_6$) alkanoic acid.

Although the polymeric nature of the alkyd and its carbon and hydrogen content help to confer an oleophilic character it is preferred that the oleophilic character be enhanced by a suitable choice of the components of the alkyd other than the polyalkylene glycol. Thus it is preferred that components be chosen which would be soluble in the oil under the conditions of demulsification. By "soluble in the oil" we mean that the component in question is soluble and non-self-associated in the particular oil which is present in the emulsion under the conditions of the treatment of the emulsion. The solution characteristics of a given oil will vary but suitable components may readily be selected by means of simple tests. An oil soluble component of the alkyd resin may be chosen from the alkyd constituents described earlier in this specification. In particular the oil soluble component may be a long-chain saturated or unsaturated aliphatic monobasic acid or long chain-alkylsubstituted aromatic monobasic acid or a "dimer" acid. Similarly the oil soluble component may be a water-insoluble polyalkylene glycol e.g. polybutylene or a polyalkylene glycol containing a significant proportion of blocks of butylene-oxy units.

Alkyd resins which are useful in the present invention may be prepared by reacting a carbonyl or ester group containing alkyd resin with the hydroxyl-terminated polyalkylene glycol by a standard esterification or transesterification technique. Alternatively the alkyd resin may be prepared from ingredients, one or more of which comprise the polyalkylene glycol unit. For example, a polyol such as glycerol may be reacted with an olefine oxide such as ethylene oxide so that the glycerol —OH groups react to produce what is in effect a glycerol/polyethylene glycol ether. This product is then reacted with the polybasic acid and optional monobasic acid under esterification conditions to form the alkyd. Similarly, a polybasic acid may be reacted with an olefine oxide to form the ester of the polyalkylene glycol and provided that it has been ensured that the polybasic acid retains one or more free —COOH groups it may be used in the alkyd forming reaction. In a third method of preparation the alkyd resin may be prepared from its basic ingredients in which the polyalkylene glycol forms one of such ingredients.

In practice the method of the present invention may conveniently be accomplished by applying to the water in oil emulsion a composition comprising an alkyd resin as hereinbefore defined dissolved or dispersed in a liquid carrier.

Suitable liquid carriers include hydrocarbons, particularly aliphatic hydrocarbons, aromatic hydrocarbons, or cyclo-aliphatic hydrocarbons containing 6 to 20 carbon atoms and it is often convenient to use hydrocarbon fractions of petroleum origin containing aromatic, aliphatic and cycloaliphatic hydrocarbons such as kerosine or gas oil.

The level of applications of the alkyd to the water-in-oil emulsion is suitably in the range 5 to 750 preferably 10 to 500 more preferably 50 to 200 parts per million. The concentration level required will depend largely on the nature of the oil to be demulsified and may readily be determined by simple experiment. Although in most cases therefore a concentration falling within the above ranges will be chosen it is possible that in some instances the optinum concentration will be outside the range for example, if an electrostatic separator is also used 5 to 50 ppm alkyd may be sufficient. Too much alkyd should be avoided however as there is a tendency for the alkyd to act as an emulsifying agent at the higher concentrations and to invert the water-in-oil emulsion to an oil-in-water emulsion.

An important use of the method according to the invention is in the breaking of water-in-oil emulsions obtained at a drilling well head. The oil rising from the well may contain emulsified water and further emulsification may take place in the well head pressure let down equipment and by injecting an alkyd according to the invention at the well head this emulsion may be broken and the water separated.

The invention will now be further described with reference to the following Examples.

In each Example an alkyd according to the invention was tested by adding it in a solvent (a mixture of aromatic hydrocarbons including methyl and ethyl substituted benzenes, naphthalenes, indene and methyl indenes sold under trademark "CAROMAX" 20), to 90 grams of Ninian crude oil and 10 grams of a 3.5% brine solution in a 100 ml stoppered measuring cylinder. The cylinder was then shaken at 25° C or 70° C for a standard 50 times and then allowed to stand for 10 minutes. The amount of water separated after this period of time was noted as was the sharpness of the break between the oil and water layers.

The molar compositions of the alkyds were as follows:

| Example | Pentaerythritol | Polyethylene glycol (PEG) mwt 600 | 800 | 1000 | Trimellitic anhydride | Tall Oil Fatty acid | % PEG |
|---|---|---|---|---|---|---|---|
| 1 | 0.62 | 3.89 | | | 2.39 | 3.0 | 65 |
| 2 | 0.64 | | 1.80 | | 1.06 | 3.0 | 55 |
| 3 | 0.60 | | | 1.10 | 0.53 | 3.0 | 51 |
| 4 | 0.81 | | | 1.72 | 1.23 | 3.0 | 60 |
| 5 | 0.29 | | | 2.46 | 1.02 | 3.0 | 71 |
| 6 | 0.81 | | 2.55 | | 1.23 | 3.0 | 63 |
| 7 | 0.60 | 2.75 | | | 1.63 | 3.0 | 59 |
| 8 | | | 3.0 | | 1.0 | 3.0 | 71 |

The test results were as follows:

| Example | ppm alkyd at 25°C nil | 50 | 250 | 500 | Break | ppm alkyd at 70°°C nil | 50 | 250 | 500 | Break |
|---|---|---|---|---|---|---|---|---|---|---|
| | mls water after 10 mins | | | | | mls water after 10 mins. | | | | |
| 1 | 2 | 9 | 8 | 9 | Goog* | 2 | 8 | 8 | 8 | Good* |
| 2 | 2 | 8 | 7 | 3 | Good* | 2 | 7 | 6 | 4 | Good* |
| 3 | 2 | 8 | 7 | 5 | Good* | 2 | 6 | 2 | 0.5 | Good* |
| 4 | 2 | 7.5 | 4 | 2 | Good* | 2 | 8 | 5 | 3 | Good* |

-continued

| Example | ppm alkyd at 25°C | | | | | ppm alkyd at 70°°C | | | | |
|---|---|---|---|---|---|---|---|---|---|---|
| | nil | 50 | 250 | 500 | Break | nil | 50 | 250 | 500 | Break |
| | mls water after 10 mins | | | | | mls water after 10 mins. | | | | |
| 5 | 2 | 8 | 7 | 7 | Good* | 2 | 8 | 8 | 8 | Good* |
| 6 | 2 | 7 | 6 | 5 | Good* | 2 | 8 | 6 | 2 | Good* |
| 7 | 2 | 8 | 8 | 4 | Good* | 2 | 7 | 5 | 1 | Good* |
| 8 | 2 | 7.5 | 4.5 | 2 | Good* | 2 | 8 | 5 | 2 | Good* |

*does not include nil alkyd in which an irregular break line was observed.

We claim:

1. A method of demulsifying a water-in-oil emulsion which comprises contacting the water-in-oil emulsion with an alkyd resin which is the condensation product of a polybasic acid selected from the group consisting of aliphatic dibasic acids containing up to 20 carbon atoms, aromatic dibasic acids containing up to 20 carbon atoms, aromatic tribasic acids containing up to 20 carbon atoms, aromatic tetrabasic acids containing up to 20 carbon atoms and dimer acid with a polyhydric alcohol and an aliphatic saturated or unsaturated mono-basic acid containing 6 to 22 carbon atoms, the polyhydric alcohol comprising a water soluble polyethylene, polypropylene or a poly(ethylene/propylene) glycol of molecular weight 400 to 10,000 and a polyhydric alcohol selected from the group consisting of mono-, di- and tri-ethylene glycol, mono-, di- and tri-propylene glycol, mono-, di- and tri-butylene glycol, neopentyl glycol, glycerol, tri-methylolpropane, trimethylolethane, pentaerythritol, dipentaerythritol, sorbitol, polypropylene glycol and polybutylene glycol, the alkyd resin containing at least 10% w/w of the water-soluble polyethylene, polypropylene or poly(ethylene/propylene) glycol and the level of application of the alkyd to the water-in-oil emulsion being 5 to 750 parts per million of emulsion.

2. A method as claimed in claim 1 in which the oil and water are contacted with the alkyd resin by applying to the oil and water the alkyd resin dissolved or dispersed in an inert liquid carrier.

3. A method as claimed in claim 2 in which the inert liquid carrier is an aliphatic, cycloaliphatic or aromatic hydrocarbon, the polyalkylene glycol is polyethylene glycol, the monobasic acid is selected from the group consisting of tall oil acids, iso-octanoic acid, 2-ethylhexanoic acid, isodecanoic acid, lauric acid, pelargonic acid and acids derived from linseed oil, soyabean oil, soya oil, whale oil, dehydrated castor oil, tung oil, fish oil, safflower oil, oiticica oil, cottonseed oil and coconut oil and the alkyd resin contains 40 to 90% by weight of the polyethylene glycol.

4. A method as claimed in claim 1 in which the water-in-oil emulsion has been obtained at a drilling well head.

* * * * *